US005623804A

United States Patent [19]

Kelly et al.

[11] Patent Number: 5,623,804

[45] Date of Patent: Apr. 29, 1997

[54] CONCRETE STRUCTURE HAVING LOAD TRANSFERRING INSERT AND METHOD FOR MAKING SAME

[75] Inventors: David L. Kelly, Sacramento, Calif.; Sidney E. Francies, III, Universal City, Tex.

[73] Assignee: The Burke Group, Sacramento, Calif.

[21] Appl. No.: 687,264

[22] Filed: Jul. 25, 1996

Related U.S. Application Data

[63] Continuation of Ser. No. 369,449, Jan. 6, 1995, abandoned.

[51] Int. Cl.[6] ..... E04B 1/38

[52] U.S. Cl. ..... 52/704; 52/707; 52/745.21

[58] Field of Search ..... 52/704, 707, 710, 52/697, 698, 506.01, 506.05, 508, 745.05, 745.09, 745.21

[56] References Cited

U.S. PATENT DOCUMENTS

| | | | |
|---|---|---|---|
| 1,948,093 | 2/1934 | Baird et al. . | |
| 2,952,947 | 9/1960 | White | 52/704 |
| 2,954,647 | 10/1960 | Lee . | |
| 3,095,672 | 7/1963 | DiTullio | 52/704 |
| 3,514,917 | 6/1970 | Merrill . | |
| 3,640,328 | 2/1972 | Tummarello | 151/41.7 |
| 3,715,851 | 2/1973 | Bennett . | |
| 4,618,464 | 10/1986 | Ditcher . | |
| 4,644,727 | 2/1987 | Hanson et al. | 52/687 |
| 4,719,724 | 1/1988 | Ditcher . | |
| 4,729,705 | 3/1988 | Higgins | 52/704 X |
| 4,752,153 | 6/1988 | Miller . | |
| 5,257,490 | 11/1993 | Endo et al. | 52/704 X |

FOREIGN PATENT DOCUMENTS

| | | | |
|---|---|---|---|
| 664178 | 6/1963 | Canada | 52/709 |
| 8813349.4 | 2/1989 | Germany . | |
| 3931494A1 | 4/1991 | Germany . | |
| 214018 | 11/1984 | United Kingdom . | |

*Primary Examiner*—Carl D. Friedman
*Assistant Examiner*—Beth A. Aubrey
*Attorney, Agent, or Firm*—Limbach & Limbach L.L.P.

[57] ABSTRACT

A support member for a concrete structure comprises a T-shaped insert defining a T-shaped internal volume. A nut is inserted in the transverse portion of the internal volume and end caps are placed over the ends of the insert to fully seal enclose the internal volume. The insert is then placed within a form for a concrete structure such that the base surface of the T-shaped insert will be coplanar with a surface of the concrete after the concrete has been poured into the form and set. The base wall of the insert is then removed, thus exposing the T-shaped volume. The distal end of a bolt can be inserted into the insert and fixed to the nut. The proximal end of the bolt extends out of the insert and beyond the surface of the concrete and can be attached to equipment or other structure which is to be supported on the concrete structure. Feet may be provided on the end caps to support the insert away from the surface of the form so that when the concrete is poured and set, the insert will be embedded within the concrete rather than contiguous with the surface of the concrete. Antennae may be provided on the end caps to extend above the base surface of the T-shaped insert so that such antenna will extend above the surface of the concrete so that the insert can be easily located visually.

43 Claims, 4 Drawing Sheets

CONCRETE STRUCTURE HAVING LOAD TRANSFERRING INSERT AND METHOD FOR MAKING SAME

This is a continuation of application Ser. No. 08/369,449 filed on Jan. 6, 1995, now abandoned.

FIELD OF THE INVENTION

The invention pertains to supporting the concrete structure or supporting other objects on the concrete structures having an insert for a concrete structures. More particularly, the invention pertains to a concrete structure having a low-cost, high-strength support member insert.

BACKGROUND OF THE INVENTION

In the construction of building structures, it is frequently necessary to support a concrete structure from another structure (concrete or otherwise). It is also frequently necessary to support heavy objects on or from concrete structures. For instance, in building constructions it may be necessary to support heavy pipes for fire suppression sprinkler systems from concrete ceilings or walls. Further, in certain industrial buildings, it may also be necessary to support heavy equipment from concrete ceilings and walls. In fact, in certain industrial buildings, equipment may need to be slidably supported on a ceiling so that it can be moved along a track or channel.

In order to support such heavy items, the load should be supported from deep within the concrete structure so that the load is transferred throughout a large volume of the concrete. Accordingly, a primary support member, such as a hanger, nut or track to which the object to be supported can be attached by means of a mating hanger or bolt is provided on the surface of the concrete. In order to transfer the load deep within the concrete, the bolt, hanger, track or other primary support member is attached to a secondary support member, such as a lug or a series of wires which is buried deep within the concrete. Since the primary support member is on the surface of the concrete, it receives substantially no support from the concrete, except through the secondary support member which is buried within the concrete. Accordingly, the secondary support member must be a heavy duty support member which is securely attached to the primary support member.

Accordingly, both the primary and secondary support members must be heavy duty support members, adding significant cost to the concrete structure.

In a situation where a heavy piece of equipment must be slidably supported in a track on a concrete structure, the track must be supported in the concrete by lugs or other secondary support members at closely spaced intervals. That is, since the heavy load may be supported anywhere within the track, the track must be strongly supported over its entire length. There cannot be a significant distance between secondary support members for the track since, if the load is supported from a point in the track which is too distant from a secondary support lug, the load will not be effectively transferred from the track to the lug. Accordingly, the track may bend or be otherwise deformed under the weight of the load.

Further, it is frequently necessary to very precisely position a support member in the concrete so that it will mate properly with the attachment hardware of another concrete structure to which it is to be attached or to another piece of equipment which is to be attached to the concrete structure. Accordingly, it is important to assure the proper placement of support members since they are buried within the concrete and are generally immoveable after the concrete has set.

Accordingly, it is an object of the present invention to provide a low-cost support member for concrete structures.

It is another object of the present invention to provide a support member for a concrete structure which is set deep within the concrete in order to supply sufficient load transfer to the concrete, yet still be moveable.

It is a further object of the present invention to provide a support member for a concrete structure which further transfers load to steel reinforcement bars embedded within the concrete.

It is yet one more object of the present invention to provide a slidable support member which transfers load deep within the concrete over its entire length.

It is yet another object of the present invention to provide a support member having feet to support the member away from a surface of the concrete structure.

It is yet a further object of the present invention to provide a support member embedded within a concrete structure which is easily visually locatable on the surface of the concrete.

SUMMARY OF THE INVENTION

The invention is a slotted support member embedded within a concrete structure. Particularly, a plastic extrusion molded insert is elongated in a first direction and has a T-shaped cross section perpendicular to the first direction. The insert is formed of a wall which defines an interior volume of the insert which also is T-shaped. The interior volume of the insert, therefore, defines an elongated channel extending in the first direction with the cross-section of the channel comprising two contiguous volumes, one being short and wide (the transverse top of the T) and the other being long and thin (the longitudinal leg of the T).

Prior to assembly, the opposite ends of the channel are open so that a nut can be inserted from either end into the short and wide portion of the channel. The two volumes are dimensioned so that the nut can fit horizontally within the transverse portion of the contiguous volume but cannot, in its horizontal orientation, fit through the longitudinal portion of the volume. Further, the nut preferably has a square perimeter the sides of which are substantially equal in length to the width of the transverse portion of the volume so that, once the nut is inserted within the insert, it cannot be rotated. Once the nut is inserted in the insert, end caps are attached to the open ends of the insert by glue or other means.

The insert is then positioned in a form within which the concrete structure will be poured and set such that when the concrete is poured, the base of the T-shaped insert (i.e., the bottom surface of the longitudinal leg) is coplanar with a surface of the concrete, but the remainder of the insert is embedded within the concrete. After the concrete has set, the wall of the insert which defines the base surface of the T is removed.

Preferably, the edges of the base which mate with the side walls of the narrow section of the insert are formed of thinner material than the remainder of the insert so that the base can be grasped by a pair of pliers or the like and pulled away from the insert. The weaker, thin portions will rip, allowing the base of the T to be easily removed.

When it is necessary to support an object on the concrete structure, a bolt attached to the other structure or equipment can be inserted into and secured to the nut which is embedded within the concrete. Accordingly, the load is transferred, through the nut, deep within the concrete.

In a preferred embodiment of the invention, the end caps not only cover the ends of the channels but have extensions beyond the T-shaped end of the channel to define hangers or holes. The hangers or holes are shaped and positioned to define a recess for supporting steel reinforcing bars parallel to the channel in the insert and in contact with the outer surface of the insert thus providing additional load transfer to the reinforcement bars of any load supported by the nut in the insert.

In the preferred embodiment, the two end caps have further extensions both above the T to form supports and below the T to form antennae. During fabrication of the concrete structure, the assembled insert, with the end caps in place, is positioned upside down within a form within which the concrete structure is to be formed with the feet of the end caps resting on an inner surface of the form. The insert, thus, is actually supported off of and above the inner surface of the form by the feet of the end caps. Accordingly, when the concrete is poured into the form, the top surface of the insert (i.e., the top of the transverse leg of the T) will not be resting on the bottom surface of the form, but will instead be supported by the feet above the form a distance equal to the height of the feet, Thus, when the concrete is set, the top of the transverse portion of the insert will be embedded within the concrete rather than coplanar with a surface of the concrete. The height of the feet can be selected relative to the desired thickness of the concrete structure and the height of the insert to assure that the base of the T-shaped insert will be coplanar with the opposite surface of the concrete structure.

Further, with the base surface of the T-shaped insert even with a surface of the concrete, the antennae which extend therefrom will stick up out of the concrete thus making it easy to visually locate the position of the insert.

According to another embodiment of the invention, the insert further includes flanges coplanar with the base surface of the insert. The flanges can be tacked to an interior surface of the form to fix the insert in a position in the form with the base surface in contact with the form interior surface. This assures that the base surface of the insert will be coplanar with a surface of the concrete structure since the interior surface of the form essentially defines the surface of the concrete structure.

DETAILED DESCRIPTION OF THE INVENTION

Figure 1:
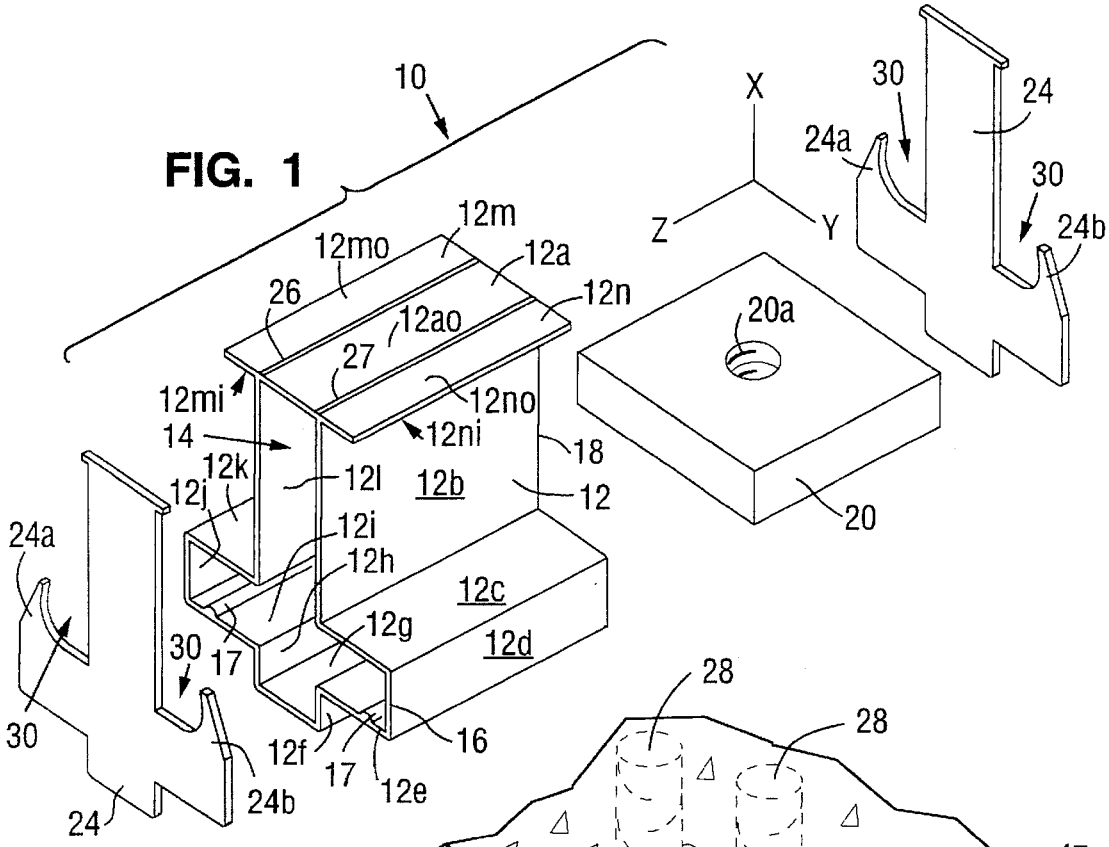
FIG. 1 is an exploded perspective view of the insert in accordance with a first embodiment of the invention.

FIGS. 1, 2, 3A, 3B and 3C illustrate a first embodiment of the preset invention. As shown, an insert 10 formed of an extruded plastic wall 12 is elongated in a first direction, the z direction in the figures, and has a cross-shaped cross section perpendicular to the z direction. The portion of the cross shape which is defined by wall portions 12*f*, 12*g*, and 12*h* can be deleted such that the insert may have a T-shaped cross section. The interior volume 14 defines a cross (or T) shaped channel extending in the z direction, as shown in FIGS. 1–3C. The interior and exterior shapes of the insert are essentially identical and are defined by twelve wall portions, namely, 12*a*–12*l*. Wall portion 12*a* defines the base of the cross. Wall portions 12*b* and 12*l* are parallel elongated side walls defining a long and thin portion of the volume. Wall portions 12*c*, 12*d* and 12*e* define one stem of a transverse leg of the cross while wall portions 12*i*, 12*j* and 12*k* define the opposing stem of the transverse leg of the cross. Finally, wall portions 12*f*, 12*g* and 12*h* define the top extension of the cross. The ends 16 and 18 of the channel are open.

The transverse portion of the interior volume 14 of the insert, which is defined by wall portions 12*c*, 12*d*, 12*e*, 12*i*, 12*j* and 12*k*, is dimensioned so that a nut 20 will fit within that volume with the nut oriented with its cross section in the y-z plane. The longitudinal portion of the interior volume of the insert 10 defined by wall portions 12*a*, 12*b*, 12*f*, 12*g*, 12*h* and 12*l*, partially overlap the transverse portion and, is sized to accept a bolt 22 extending in the x direction so that the bolt can be screwed into the nut 20. Preferably, the cross section of the nut is square and is sized to substantially fill the transverse portion of the volume of the insert in the x and y directions, but not in the z direction. Accordingly, the nut can be slid in the z direction in the channel, but is substantially immovable in the x and y directions. Ridges 17 are provided on the interior sides of walls 12*e* and 12*i* so that nut 20 rests on the ridges when it is placed in the insert 10. In a preferred embodiment of the invention, the ridges are sized relative to the thickness of the nut to provide a light frictional fit of the nut between the tops of the ridges and the interior sides of walls 12*c* and 12*k*.

The bolt 22 preferably is sized to substantially fill the longitudinal portion of the volume of the insert in the x and y directions, but not in the z direction. The bolt obviously should have a thread and a diameter so that it mates with the threaded hole 20*a* in the nut 20.

In a preferred embodiment of the invention, flanges 12*m* and 12*n* extend from the insert 10 coplanar with the base wall portion 12*a*. Further, the edges 26 and 27 of wall portion 12*a* are formed of thinner plastic than the remainder of the insert so that wall portion 12*a* can be ripped along edges and 26 and 27 to remove it from the insert at a later time, as will be discussed below.

The device also includes two end caps 24 which are shaped so as to cover the opens ends 16 and 18 of the insert 10. After the nut is placed in the insert, end caps 24 are attached to the opposing edges of the insert so as to fully enclose the internal volume of the insert. The end caps may be attached by adhesive, such as glue, or by other means.

End caps 24 are shaped substantially in accordance with the shape of openings 16 and 18 so that the internal volume of the insert can be fully enclosed. However, in a preferred embodiment, end caps 24 include additional extensions such as extensions 24*a* and 24*b*. These extensions define hanger portions within which steel reinforcement bars can be supported, as will be described below.

Figure 2:
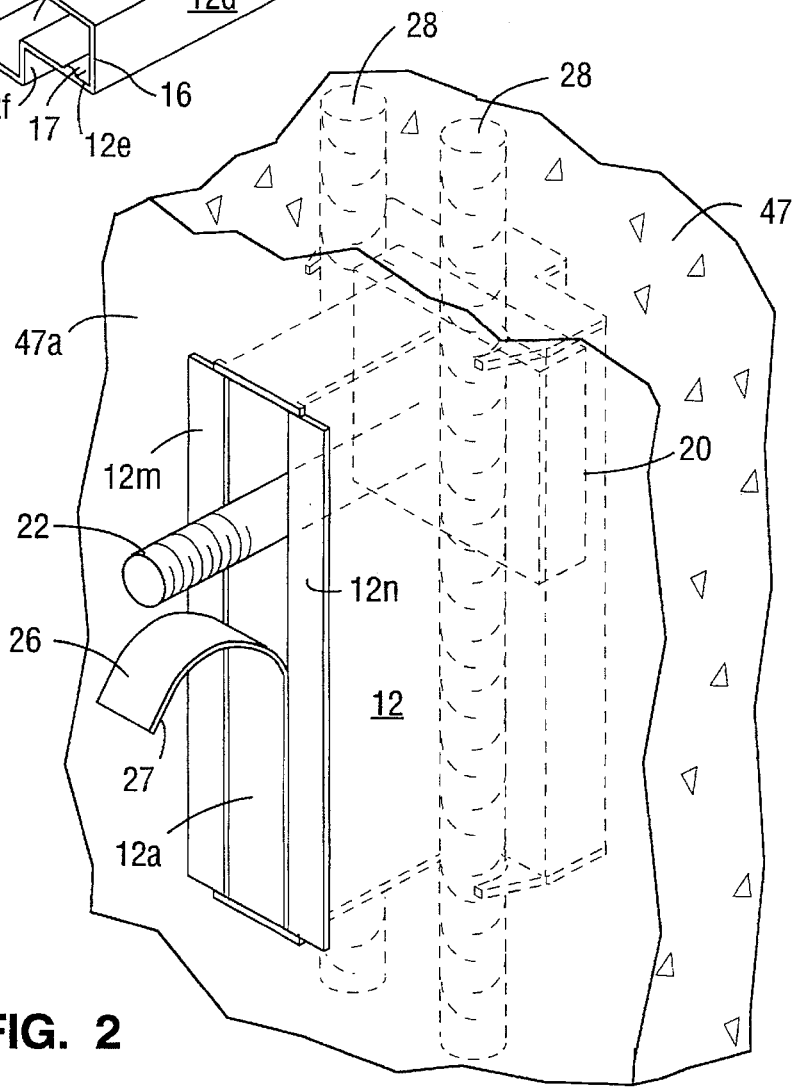
FIG. 2 is a cut-away perspective view of an insert embedded within a steel reinforced concrete structure in accordance with the first embodiment of the invention.
Figure 3C:
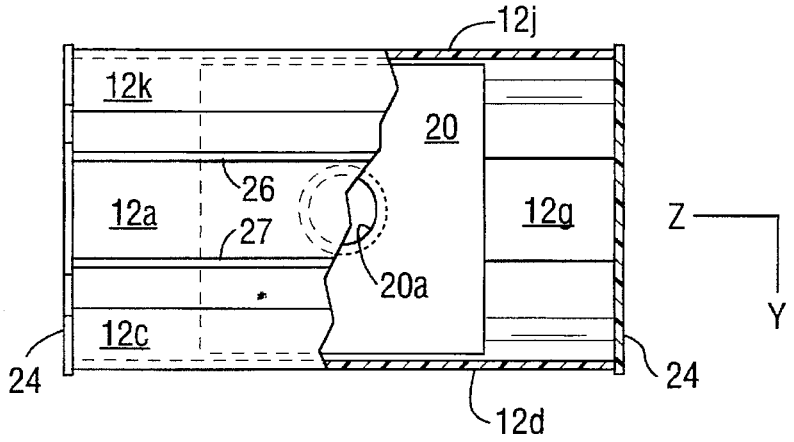
FIGS. 3A, 3B, and 3C are side, end and plan views, respectively, of the insert in accordance with the first embodiment of the invention.
Figure 3A:
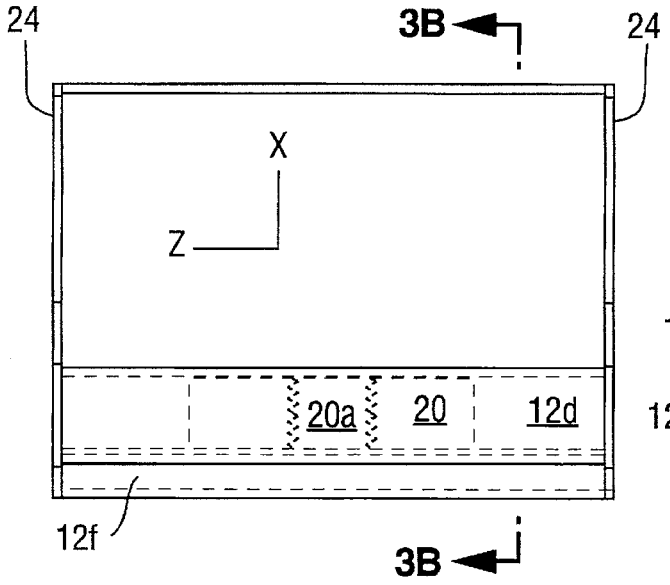
Figure 3B:
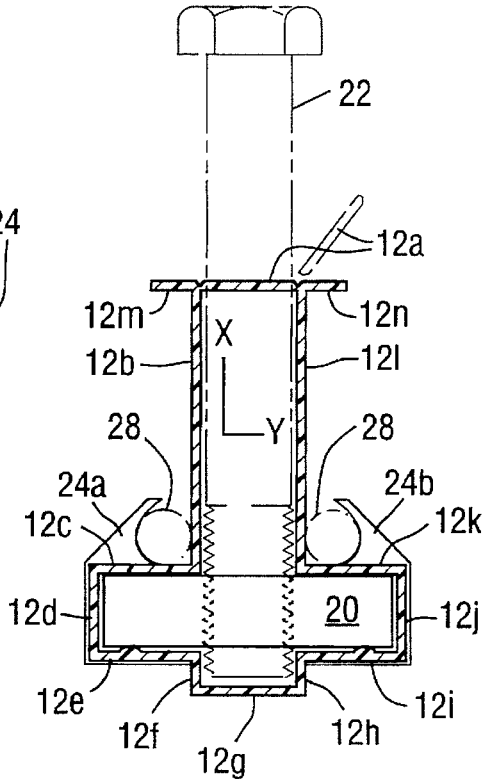
Figures 4, 5:
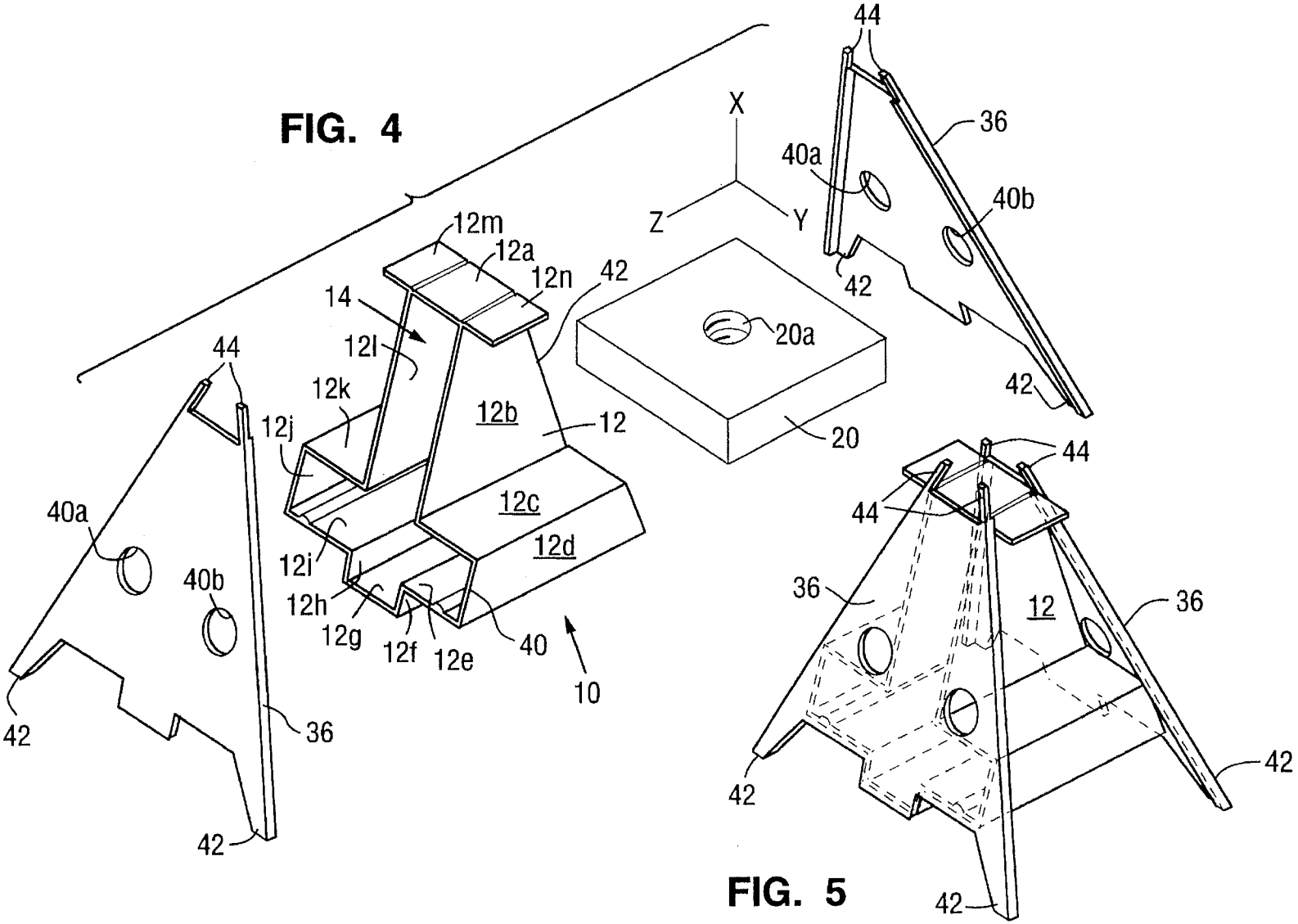
FIG. 4 is an exploded perspective view of the insert in accordance with a second embodiment of the invention.
FIG. 5 is a perspective view of an insert embedded within a steel reinforced concrete structure in accordance with the second embodiment of the invention.
Figure 6C:
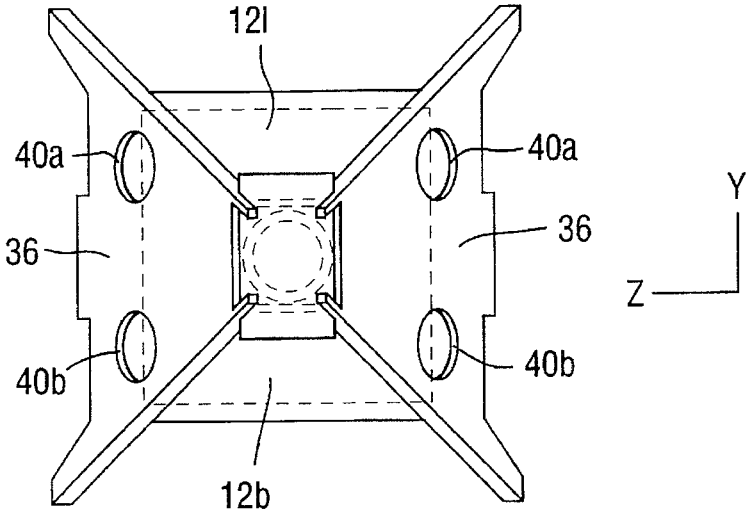
FIGS. 6A, 6B and 6C are side, end and plan view, respectively, of the insert in accordance with the second embodiment of the invention.
Figure 6A:
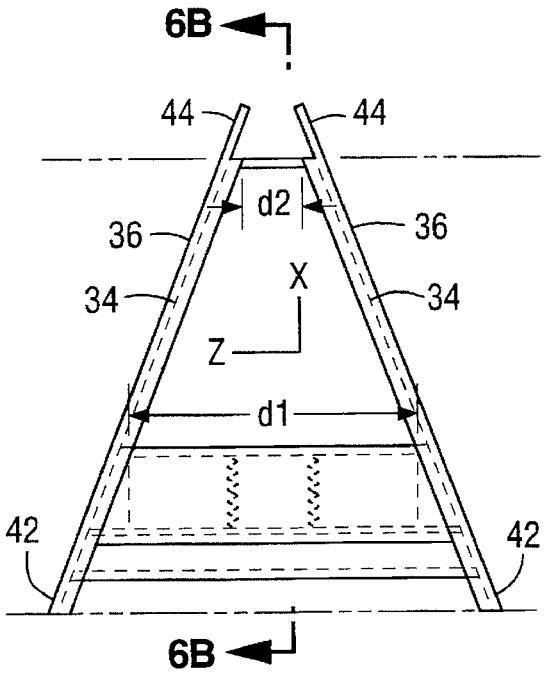
Figure 6B:
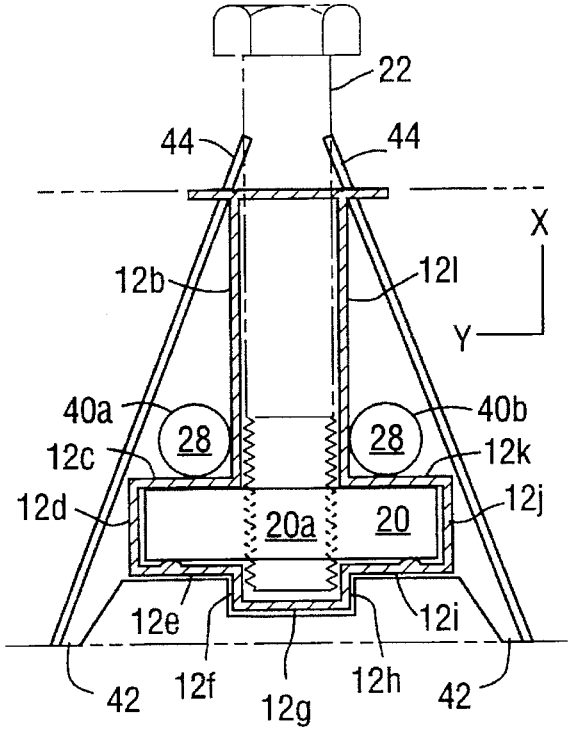

With reference to FIG. 2 in particular, a concrete structure having one or more support members in accordance with the present invention is constructed as follows. The nut is inserted into the insert as previously described. Then, end caps 24 are attached to the ends 16 and 18 of the insert by glue or other attachment means. The insert 10 is then placed in a form within which the concrete structure is to be made. The insert is positioned so that base wall portion 12*a* will be coplanar with a surface of the concrete structure after the concrete is poured in the form and set. With the end caps 24 in place, the internal volume of the insert is now completely sealed so that the concrete can be poured and it will not enter the insert.

Proper positioning of the insert so that base wall portion 12*a* is coplanar with the surface of the concrete can be accomplished in several manners. First, the insert may be placed in the form with the base wall portion 12*a* facing downwardly and in contact with the bottom surface of the form. Accordingly, when concrete is poured into the form, it will not cover wall portion 12*a* since it is in contact with the bottom wall of the form (which, by definition, defines the surface of the concrete).

Alternately, the insert may be placed in the form with base wall 12*a* facing up and the insert supported on a pedestal such that when the proper amount of concrete is poured in to the form, the top surface of the concrete will be coplanar with wall portion 12*a*. Of course, it is also possible to form insert 10 so that the distance between base wall portion 12*a* and opposing wall portion 12*g* is exactly equal to the desired depth of the concrete. Then, if wall portion 12*g* is placed on the inner surface of the form, when the concrete is poured, the opposite wall portion, 12*a*, will be coplanar with the top surface of the concrete. However, this method is not recommended because wall portion 12*g* will be coplanar with the opposing surface of the concrete, rather than embedded deep within the concrete, as desired.

In a preferred embodiment of the invention, insert 10 may be supported in the appropriate orientation and position by steel reinforcement bars 28 in the concrete. Particularly, extensions 24*a* and 24*b* on the end caps 24 define a space 30 within which steel reinforcement bars 28 can be supported as shown in FIG. 2. The position of the reinforcement bars 28 in the form and/or the length of wall portions 12*b* and 12*l* are selected so that when the insert is supported on the reinforcing bars, base wall 12*a* will be coplanar with a surface of the concrete structure.

However, in a more preferred embodiment of the invention, flanges 12*m* and 12*n* provide the means by which the insert is mounted on the concrete form to assure that base wall portion 12*a* is coplanar with a surface of the concrete. Particularly, the insert can be tacked to an inner surface of the form by driving tacks through flanges 12*m* and 12*n* into the inner surface of the form. More particularly, the insert is manually held in place with the outer surfaces $12a_o$, $12m_o$ and $12n_o$ of wall portions 12*a*, 12*m* and 12*n*, respectively, in contact with the form. Nails or tacks are then driven through the wall portions 12*m* and 12*n* from their inner surfaces $12m_i$ and $12n_i$, through the wall portions 12*m* and 12*n* and into the surface of the form, thus securing the base wall portion 12*a* and flanges 12*m* and 12*n* in contact with the form surface.

Once the concrete structure is set, wall portion 12*a* can be grasped by a pair of pliers or other grasping tool and ripped off of the insert, thereby exposing the interior volume of the insert. The bolt 22 can be inserted into the volume and screwed into nut 20. The portion of the longitudinal volume which is defined by wall portions 12*f*, 12*g* and 12*h* allows the distal end of the bolt to extend beyond the nut a short length. This feature assures that the bolt can be fully inserted into and through the nut, thus providing maximum thread engagement between the bolt and the nut.

The bolt length is greater than the length of wall portions 12*b* and 12*l* of the insert to ensure that the bolt will stick out of the insert when its distal end is threaded into the nut 20. In fact, preferably, the bolt is longer than the distance between wall portions 12*a* and 12*g* of the insert. The proximal end of the bolt, which sticks out of the insert, can be attached to another object upon which the concrete structure is to be supported or to an object which is to be supported by the concrete structure. The bolt may be threaded at its proximal end in order to allow attachment to the other object. Alternately, the proximal end of the bolt may be welded to the other object. Even further, the bolt may simply be an integral part of the other object.

In the present invention as described above, the bolt 22 and the object to which it is attached is supported by the nut 20, which is embedded deep within the concrete. The nut rests on shoulders formed by wall portions 12*c* and 12*k*, thus providing load transfer through the wall portions 12*c* and 12*k* to the concrete and very high strength in the x and y directions. At the same time, the nut is freely movable in the z direction. The mobility in the z direction is advantageous for two reasons. First, it allows a margin of error or tolerance in the z direction since, unlike the prior art, the support member (i.e., the nut 20) can be moved in the Z direction even after the concrete has set. Further, in applications where the nut is used to support equipment or other structures which are to be slidable along the surface of the concrete, the channel allows such mobility without the need for a surface mounted track and complex and expensive secondary support equipment. Particularly, since the nut is embedded deep within the concrete, it can be slid to anywhere within the channel and it will have equivalent load transfer through the concrete to provide extremely high strength in the x and y directions.

Even further, as shown in FIG. 2, when steel reinforcement bars 28 are used, the load in the x direction is transferred, not only to the concrete, but also to the reinforcement bars 28 which are in contact with the wall portions 12*c* and 12*k* of the insert. Accordingly, any weight supported in the x direction by the nut is transferred through wall portions 12*c* and 12*k* to the steel reinforcement bars as well as the concrete.

The dimension of the interior volume of the insert in the y direction may be selected to provide for some tolerance for misalignment in that direction also. In other words, the distance between wall portions 12*d* and 12*j* may be made slightly greater than the cross section of the nut and the distance between wall portions 12*b* and 12*l* can be slightly larger than the diameter of the bolt. In this manner, the nut and bolt is moveable in the y direction a small amount also. Of course, however, the distance between wall portions 12*b* and 12*l* should not exceed or even approach the cross section of the nut as wall portions 12*c* and 12*k* would no longer be able to sufficiently support the nut on the shoulder formed by those wall portions.

As previously mentioned, the nut preferably is square so that it cannot rotate once it is placed in the insert. The nut, however, may also be hexagonal, octagonal or many other shapes to achieve the same result. However, if the distance between wall portions 12*d* and 12*j* is made too great, the nut may be able to rotate in the insert, which, in most applications is undesirable since it would make it difficult to secure a bolt into the nut.

In embodiments of the invention in which slidable engagement of an object with the concrete structure is not necessary, the length of the channel (in the z direction) might be on the order of two to six inches for purposes of providing a tolerance in the z direction in positioning the insert. In embodiments in which the invention is used to provide a slidable mount for equipment or other apparatus, however, applicant envisions an insert having a length (in the z direction) of six inches to ten feet and greater.

FIGS. 4–6C illustrate an alternative embodiment of the present invention in which the nut is substantially immoveable in all directions, including the z direction. Accordingly, this embodiment is not suitable for applications for slidably mounting equipment to the concrete structure. In this embodiment, the starting structure for the support member is insert 10 of the first embodiment. However, in this embodiment, the insert is cut along lines 34 shown in FIG. 6A which are oblique to the base surface of the insert to form the insert into somewhat of a pyramid shape. The open ends of the channel within insert 10 in this embodiment are, therefore, different than in the first embodiment in that they are sloped or oblique.

The angle of cut lines 34 and the distance, $d_1$, (see FIG. 6A) are selected so that the length in the z direction of the transverse portion of the volume is substantially equal to the cross section of the nut so that the nut is substantially immovable in all directions, including the z direction. Further, the angle of cut lines 34 are selected so that the distance, $d_2$, in the z direction is large enough to accept a bolt, but not significantly larger, such that the bolt also is generally immovable in all directions.

End caps 36 of this embodiment are triangular in shape such that they not only cover the open ends 40 and 42 of the insert 10, but also extend beyond the edges of the insert defined by wall portions 12*a*–12*l* of the insert. Each end cap is provided with two holes, 40*a* and 40*b*, through which steel reinforcement bars 28 can be inserted. The holes are positioned so that the steel reinforcement bars 28 will rest on the surfaces of wall portions 12*c* and 12*k* of the insert. Further, each end cap is provided with two feet, 42 and two antennae 44. When a concrete structure is formed with these inserts in it, the antennae 44 will stick out beyond the surface of the concrete allowing the positions of the inserts to be easily determined visually.

The feet 44 extend beyond the bottom wall portion 12*g* of the insert to essentially provide a built-in pedestal for supporting the insert in the form. Accordingly, with the end caps of this embodiment of the invention, the position of the inserts such that base wall portion 12*a* is coplanar with the surface of the concrete can be set either by tacking flanges 12*m* and 12*n* to an inner surface of the form or by resting feet 42 on the form to act as a built-in pedestal.

Of course, the second embodiment of the invention also can be adapted to provide a slidable mount (as in the first embodiment) by selecting distances d1 and d2 to be greater than the width of the nut and bolt, respectively. Further, the T-shaped and cross-shaped cross sections discussed above are exemplary. Any cross sectional shape which would allow the nut to rest securely on a shoulder within the insert would be acceptable.

Also, rather than using a separate nut and bolt, a T-shaped bolt can be used for placement in the insert. Particularly, rather than inserting a nut in the insert prior to placement in the concrete, the insert can be placed in the concrete without containing a nut. After the concrete is set and the wall portion 12*a* is removed, a T-bolt can be inserted in the insert through the opening where wall portion 12*a* had been by aligning the transverse leg of the T-bolt parallel with the channel. When the bolt is inserted deep enough into the insert such that the transverse leg of the bolt is in the transverse portion of the internal volume of the insert, the bolt can be rotated 90 degrees. In this orientation, the transverse leg of the T-bolt is now perpendicular to the internal channel such that the bolt cannot be withdrawn from the insert because the transverse leg of the T-bolt no longer can fit into the longitudinal portion of the internal volume of the insert.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

We claim:

1. A concrete support apparatus for supporting thereon an object, said apparatus comprising;

a concrete structure having a surface, a reinforcement bar disposed in said concrete structure, a primary support member for securely engaging a secondary support member attached to said object, and an insert embedded in said concrete structure and having an interior volume and an opening coplanar with said surface of said structure with a remainder of said insert being embedded within said concrete structure, said insert comprising a wall defining said interior volume, said interior volume having first and second contiguous portions, said first portion sized and shaped to accept said primary support member in a first orientation and said second portion sized and shaped such that said primary support member does not fit into said second portion when in said first orientation, said primary support member being disposed in said first portion of said interior volume of said insert, whereby said secondary support member can be attached to said primary support member and a load of said object is transferred through said concrete structure, wherein said insert further comprises an extension projecting beyond said wall, said extension defining a recess for engaging a reinforcement bar in a position relative to said insert such that said load of said object is also transferred through said reinforcement bar.

2. The apparatus as set forth in claim 1 wherein a portion of said wall defines a shoulder upon which said support member rests, said load being transferred to said concrete and said reinforcement bar through said shoulder.

3. The apparatus as set forth in claim 2 wherein said insert has an open end sized and shaped to accept said support member into said first portion in said first orientation, said insert further comprising an end cap sized and shaped to cover said open end.

4. The apparatus as set forth in claim 3 wherein said extension is positioned on said end cap.

5. The apparatus as set forth in claim 4 wherein said recess is positioned to dispose said reinforcement bar in contact with a portion of an exterior side of said wall corresponding to said shoulder, whereby said load is also transferred to said reinforcement bar.

6. The apparatus a set forth in claim 5 wherein said insert is elongated in a first direction such that said interior volume defines a channel extending in said first direction within which said primary support member can slide in said first direction.

7. The apparatus as set forth in claim 6 wherein said insert and said interior volume of said insert have cross sectional shapes in a plane perpendicular to said first direction which are T-shaped.

8. The apparatus as set forth in claim 1 wherein said insert and said interior volume of said insert have cross sectional shapes in a plane perpendicular to said first direction which are cross-shaped.

9. The apparatus as set forth in claim 8 wherein said insert is formed of extruded plastic.

10. The apparatus as set forth in claim 8 wherein said end cap is secured to said insert by means of an adhesive.

11. The apparatus as set forth in claim 1 wherein said insert has two opposing open ends and further comprises two end caps sized and positioned to cover said ends and further wherein said opposing ends are oblique to said first surface of said insert.

12. The apparatus as set forth in claim 11 wherein each end cap comprises an antenna which extends from said insert and said surface of said concrete.

13. The apparatus as set forth in claim 12 wherein each end cap comprises two feet which extend outwardly from said insert in a direction generally opposite from said antenna, whereby said feet of said two end caps form a pedestal for supporting said insert above a surface.

14. The apparatus as set forth in claim 1 wherein said insert further comprises a flange extending outwardly from said insert coplanar with said first surface, whereby said flange provides a surface which can be tacked to a concrete form for fixedly positioning said insert relative to said form.

15. The apparatus as set forth in claim 14 wherein said flange comprises two flanges extending in opposite directions from said insert.

16. The apparatus as set forth in claim 1 wherein said primary support member comprises a nut and said secondary support member comprises a bolt for engaging said nut.

17. The apparatus as set forth in claim 1 wherein said primary support member comprises a bolt having a head portion disposed in said first portion of said insert and further comprising a longitudinal portion disposed in said second portion of said insert.

18. The apparatus as set forth in claim 17 wherein said bolt head is sized and shaped so as to be able to pass through said opening and said second portion into said first portion while in a second orientation and then be rotated into said first orientation.

19. An apparatus for placement in a concrete structure for supporting an object on said concrete structure, said apparatus comprising;

a support member for securely engaging a bolt attached to said object, and an insert comprising a wall which defines an interior volume having first and second contiguous portions, said first portion sized and shaped to accept said support member in a first orientation and said second portion sized and shaped such that said support member does not fit into said second portion when in said first orientation, said support member being disposed in said first portion of said interior volume of said insert wherein said insert further comprises an antenna which extends outwardly from said first surface so as to protrude from said concrete structure when said insert is placed in said structure with said first surface coplanar with a surface of said concrete structure.

20. The apparatus as set forth in claim 19 wherein said insert further comprises a first sealable opening adjacent said second portion for allowing said bolt to extend into said insert and a flange extending outwardly from said insert coplanar with said first opening, whereby said flange provides a surface attachable to a concrete form for fixedly positioning said insert with said first opening in contact with said form, whereby said first opening will be coplanar with a surface of said concrete structure when poured and set in said form.

21. The apparatus as set forth in claim 19 wherein said insert is open at first and second ends positioned at opposite extremes of said insert in a first direction which is parallel to said first surface, said ends sized and shaped to accept said support member into said first portion in said first orientation.

22. The apparatus as set forth in claim 21 further comprising two end caps sized and shaped to completely cover said two open ends of said insert wherein each end cap comprises said antenna.

23. The apparatus as set forth in claim 22 wherein each end cap comprises two feet which extend outwardly from said insert in a direction generally opposite from said antenna, whereby said feet of said two end caps form a pedestal for supporting said insert above a surface.

24. The apparatus as set forth in claim 23 wherein said opposing ends of said insert and said end caps are oblique to said first surface of said insert.

25. The apparatus as set forth in claim 21 wherein said insert is elongated in said first direction such that said interior volume defines a channel extending in said first direction within which said nut and bolt can slide in said first direction.

26. The support member as set forth in claim 25 wherein said interior volume of said insert has a cross section perpendicular to said first direction sized and shaped to allow substantially no movement of said nut and bolt in any direction other than said first direction.

27. The apparatus as set forth in claim 20 wherein said insert further comprises a cover for sealing said opening.

28. The apparatus as set forth in claim 19 wherein said insert further comprises an extension, said extension defining a recess for engaging a reinforcement bar in a position relative to said insert such that said load of said object is also transferred through said bar.

29. The apparatus as set forth in claim 19 wherein said support member comprises a nut for engaging said bolt.

30. The apparatus as set forth in claim 19 wherein said support member comprises a bolt head integral with said bolt.

31. The apparatus as set forth in claim 30 wherein said bolt head is sized and shaped so as to be able to pass through said opening and said second portion into said first portion while in a second orientation and then be rotated into said first orientation.

32. The apparatus as set forth in claim 20 wherein said first surface is defined by a strip in said wall formed of a weaker material than the remainder of said wall.

33. A support member as set forth in claim 32 wherein said insert is formed of extruded plastic and wherein said strip is formed of thinner plastic than the remainder of the insert.

34. A method of fabricating a concrete structure having a support member embedded within the concrete of said structure for supporting an object on said concrete structure with a load of said object transferred through said concrete, said method comprising the steps of;

(1) providing a form defining a shape of said concrete structure, said form including at least one reinforcement bar, (2) positioning an insert in said form, said insert comprising a first surface and defining an enclosed interior volume having first and second contiguous portions, said first portion sized and shaped to accept a support member in a first orientation and said second portion sized and shaped such that said support member does not fit into said second portion when in said first orientation, said insert further comprising a recess for engaging said reinforcement bar (3) providing a support member in said first portion of said interior volume of said insert in said first orientation, (4) engaging said recess with said reinforcement bar, (5) pouring concrete into said form such that no concrete enters said interior volume of said insert and so that a surface of said concrete structure is formed coplanar with said first surface of said insert, and (6) removing at least a portion of said first surface of said insert to provide an opening through which said object can be attached to said support member.

35. The method as set forth in claim 34 wherein step (3) comprises the steps of;

(3.1) inserting said nut into an open end of said insert, and (3.2) fixing an end cap to said open end so as to completely enclose said interior volume of said insert such that concrete cannot enter said interior volume.

36. The method as set forth in claim 35 wherein said insert further comprises a flange extending outwardly from said insert coplanar with said first surface, and wherein step (2) comprises the steps of;

(2.1) positioning said insert with said flange in contact with an interior surface of said form, and (2.2) tacking said flange to said interior surface of said form.

37. The method as set forth in claim 35 wherein said insert further comprises extensions including recessed for accepting reinforcement bars and wherein step (2) further comprises the step of:

(2.1) mounting said insert onto a reinforcement bar provided in said form.

38. The apparatus as set forth in claim 27 wherein said flange comprises two flanges extending in opposite directions from said insert.

39. An apparatus for placement in a concrete structure for supporting an object on said concrete structure, said apparatus comprising;

a support member for securely engaging a bolt attached to said object, and an insert comprising a wall which defines an interior volume having first and second contiguous portions, said first portion sized and shaped to accept said support member in a first orientation and said second portion sized and shaped such that said support member does not fit into said second portion when in said first orientation, said support member being disposed in said first portion of said interior volume of said insert, wherein said insert comprises a first opening for being positioned coplanar with a surface of said concrete structure, and wherein said insert further comprises a plurality of feet which extend outwardly from positions on said insert generally opposite said opening so as to form a pedestal for supporting said insert above a surface.

40. The method of fabricating a concrete structure having a support member embedded within the concrete of said structure for supporting an object on said concrete structure with a load of said object transferred through said concrete, said method comprising the steps of;

(1) providing a form defining a shape of said concrete structure, (2) positioning an insert in said form, said insert comprising a first surface and defining an enclosed interior volume having first and second contiguous portions, said first portion sized and shaped to accept a support member in a first orientation and said second portion sized and shaped such that said support member does not fit into said second portion when in said first orientation, said insert further comprising a flange extending outwardly from said insert coplanar with said first surface, (3) providing a support member in said first portion of said interior volume of said insert in said first orientation, (4) positioning said insert with said flange in contact with an interior surface of said form, (5) attaching said flange to said interior surface of said form, (6) pouring concrete into said form such that no concrete enters said interior volume of said insert and so that a surface of said concrete structure is formed coplanar with said first surface of said insert, and (7) removing at least a portion of said first surface of said insert to provide an opening through which a bolt can be inserted into said support member.

41. A method of fabricating a concrete structure having a support member embedded within the concrete of said structure for supporting an object on said concrete structure with a load of said object transferred through said concrete, said method comprising the steps of;

(1) providing a form defining a shape of said concrete structure, said form including at least one reinforcement bar, (2) positioning an insert in said form, said insert comprising a first surface and defining an enclosed interior volume sized and shaped to accept insertion of a support member in a first orientation such that, after insertion, said support member can be moved to a second orientation in which said support member cannot be removed from said insert, said insert further comprising a recess for engaging said reinforcement bar, (3) engaging said recess with said reinforcement bar, (4) pouring concrete into said form such that no concrete enters said interior volume of said insert and so that a surface of said concrete structure is formed coplanar with said first surface of said insert, (6) removing at least a portion of said first surface of said insert to provide an opening through which a support member can be inserted into said insert, and (7) inserting a support member into said insert in said first orientation and moving said support member to said second orientation.

42. A concrete support apparatus for supporting an object on said apparatus, said apparatus comprising;

a concrete structure having a surface, a support member for securely engaging a bolt attached to said object, and an insert disposed in said concrete structure having an opening to an interior volume of said insert, said opening being coplanar with said surface of said structure and with a remainder of said insert being embedded within said concrete structure, said interior volume having first and second contiguous portions, said first portion sized and shaped to accept said support member in a first orientation and said second portion sized and shaped such that said support member does not fir into said second portion when in said first orientation, said insert having two opposing open ends through which said support member can be inserted into said first portion of said interior volume in said first orientation and further comprising two end caps sized and positioned to cover said ends and further wherein said opposing ends are oblique to said first surface of said insert, said support member being disposed in said first portion of said interior volume of said insert, whereby said bolt can be attached to said support member and a load of said object is transferred through said concrete.

43. An apparatus for placement in a concrete structure for supporting an object on said concrete structure, said apparatus comprising;

a support member for securely engaging a bolt attached to said object, and an insert comprising a wall which defines an interior volume having first and second contiguous portions, said first portion sized and shaped to accept said support member in a first orientation and said second portion sized and shaped such that said support member does not fit into said second portion when in said first orientation, said support member being disposed in said first portion of said interior volume of said insert, wherein said insert is elongated in a first direction such that said interior volume defines a channel extending in said first direction within which said nut and bolt can slide in said first direction and said interior volume of said insert has a cross section perpendicular to said first direction sized and shaped to allow substantially no movement of said nut in any direction other than said first direction.

* * * * *